US007293304B2

(12) United States Patent
Chen et al.

(10) Patent No.: US 7,293,304 B2
(45) Date of Patent: Nov. 13, 2007

(54) FOLDABLE BABY CRIB

(75) Inventors: Shun-Min Chen, Taipei (TW); Jian-Qun Li, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 0 days.

(21) Appl. No.: 11/328,824

(22) Filed: Jan. 9, 2006

(65) Prior Publication Data

US 2007/0011809 A1 Jan. 18, 2007

(30) Foreign Application Priority Data

Jul. 12, 2005 (CN) ..... 2005 2 0111341 U

(51) Int. Cl.
*A47D 13/06* (2006.01)

(52) U.S. Cl. ..... 5/99.1; 5/98.1

(58) Field of Classification Search ..... 5/98.1–99.1
See application file for complete search history.

(56) References Cited

U.S. PATENT DOCUMENTS 4,688,280 A * 8/1987 Kohus et al. ..... 5/99.1
4,811,437 A * 3/1989 Dillner et al. ..... 5/99.1
5,526,542 A 6/1996 Huang
6,079,063 A 6/2000 Cheng
6,721,970 B1 * 4/2004 Cheng ..... 5/99.1
6,721,971 B1 4/2004 Cheng
7,043,780 B1 * 5/2006 Cheng ..... 5/99.1

OTHER PUBLICATIONS

European Search Report (extended) dated Dec. 28, 2006, for EP06119123.5, in the name of Wonderland Nursery Goods Co., Ltd.

* cited by examiner

*Primary Examiner*—Michael Trettel
(74) *Attorney, Agent, or Firm*—Christie, Parker & Hale, LLP

(57) ABSTRACT

A foldable baby crib includes a top frame unit, a bottom frame unit, a plurality of support rods, each of which has a top end segment connected to the top frame unit, and a bottom end segment opposite to the top end segment, and a plurality of foot members, each of which is connected fixedly to the bottom frame unit and is connected pivotally to the bottom end segment of a respective one of the support rods.

19 Claims, 11 Drawing Sheets

FOLDABLE BABY CRIB

CROSS-REFERENCE TO RELATED APPLICATION

This application claims priority of Chinese application no. 200520111341.2, filed on Jul. 12, 2005.

BACKGROUND OF THE INVENTION

1. Field of the Invention

The invention relates to a crib, more particularly to a foldable baby crib.

2. Description of the Related Art

Referring to FIG. 1, a conventional foldable baby crib 1 is shown to include a plurality of top rods 25, a plurality of bottom rods 21, a plurality of support rods 22, a plurality of foot members 23, and a rod hub 24. Each support rod 22 has a top end connected to a respective one of the top rods 25, and a bottom end connected to a respective one of the bottom rods 21 through a corresponding one of the foot members 23. Each bottom rod 21 has one end connected pivotally to the rod hub 24. When folding the baby crib 1, the rod hub 24 is lifted upwardly to bring the bottom rods 21 and the support rods 22 close together. As shown in FIG. 2, for each foot member 23, the bottom end of the corresponding support rod 22 is fixed therein, whereas the corresponding bottom rod 21 is connected pivotally thereto. Since the foot members 23 are not foldable relative to the support rods 22, a combined length of the support rod 22 and the corresponding foot member 23 is not reduced when the baby crib 1 is folded.

SUMMARY OF THE INVENTION

Therefore, the object of the present invention is to provide a foldable baby crib that has a more compact size when in a folded state as compared to the prior art.

Accordingly, a foldable baby crib of the present invention comprises a top frame unit, a bottom frame unit, a plurality of support rods, each of which has a top end segment connected to the top frame unit, and a bottom end segment opposite to the top end segment, and a plurality of foot members, each of which is connected fixedly to the bottom frame unit and is connected pivotally to the bottom end segment of a respective one of the support rods.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
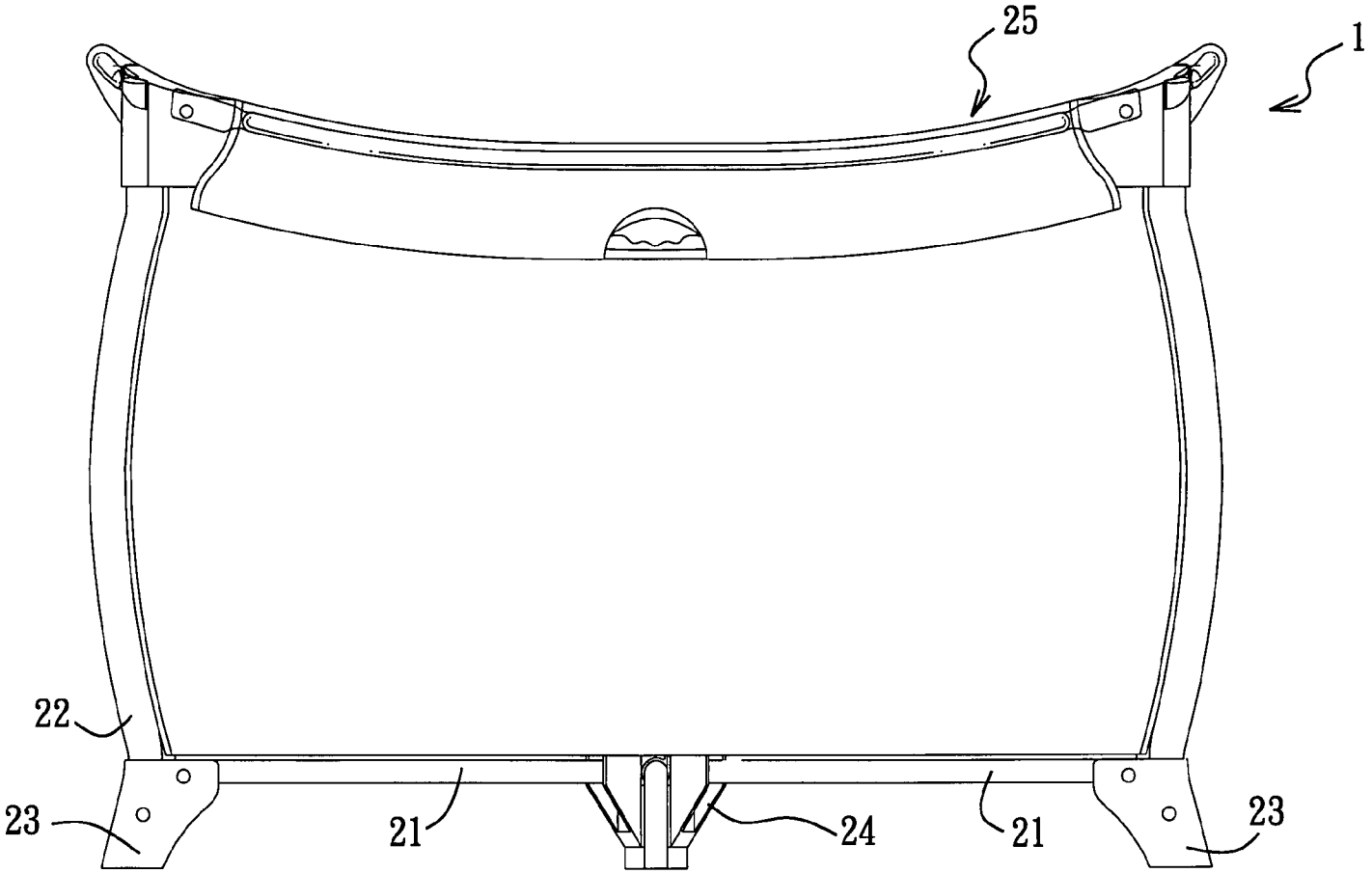
FIG. 1 PRIOR ART
FIG. 1 is a schematic view of a conventional foldable baby crib.
Figure 2:
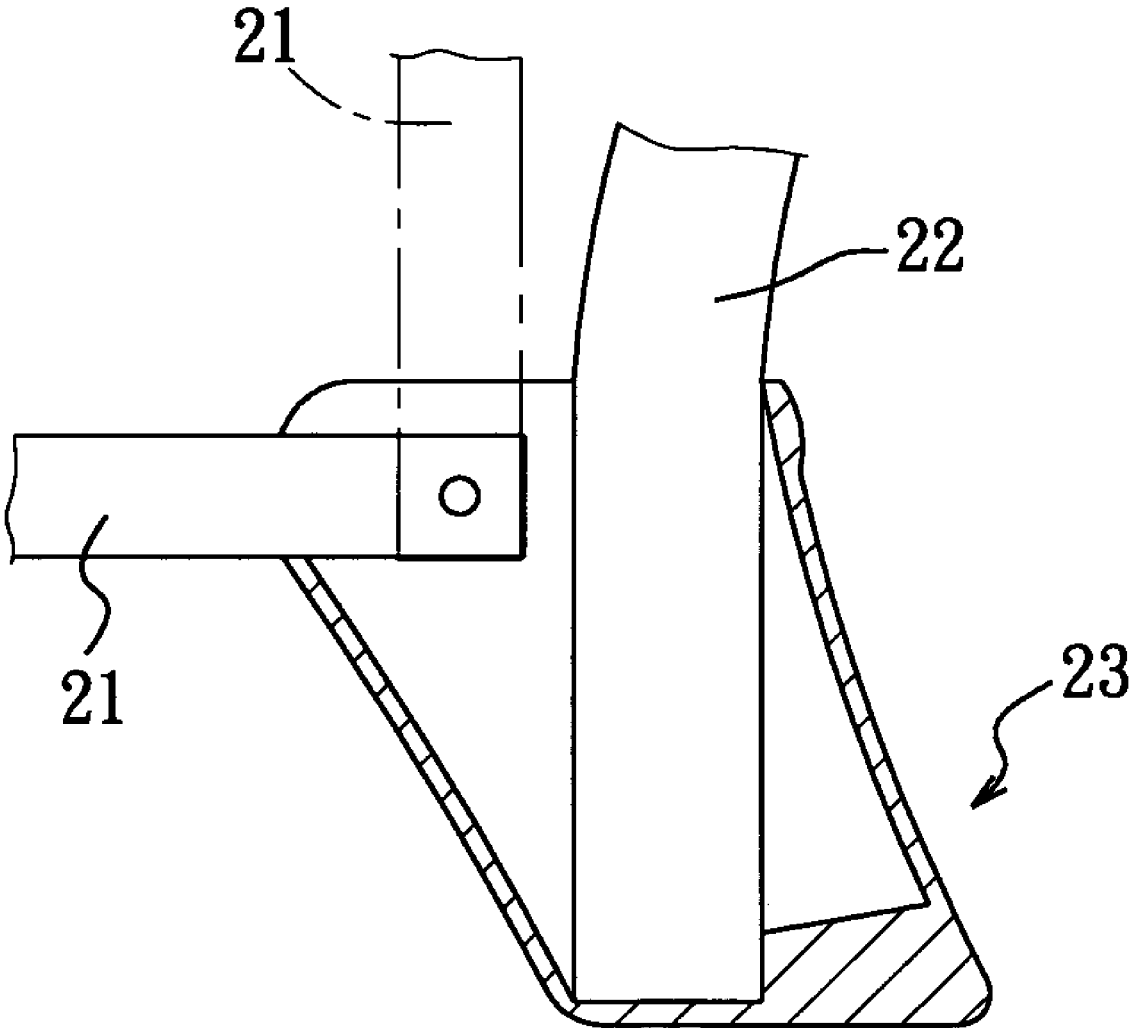
F I G. 2 PRIOR ART
FIG. 2 is a fragmentary schematic sectional view for illustrating connection among a support rod, a bottom rod, and a foot member of the conventional foldable baby crib of FIG. 1.

Before the present invention is described in greater detail with reference to the following preferred embodiments, it should be noted herein that like elements are denoted by the same reference numerals throughout the disclosure.

Figure 3:
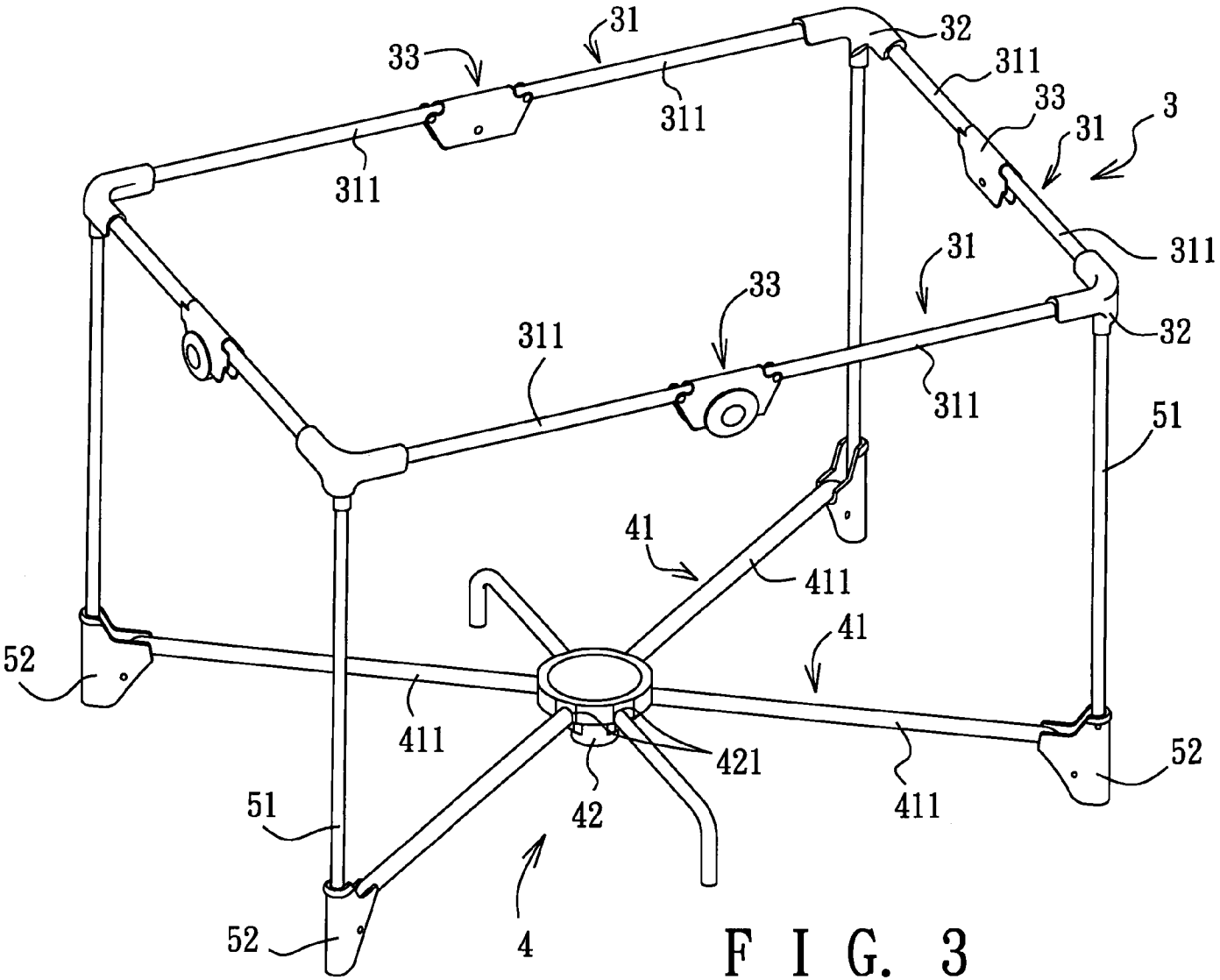
FIG. 3 is an assembled perspective view of the first preferred embodiment of a foldable baby crib according to the present invention.
Figure 4:
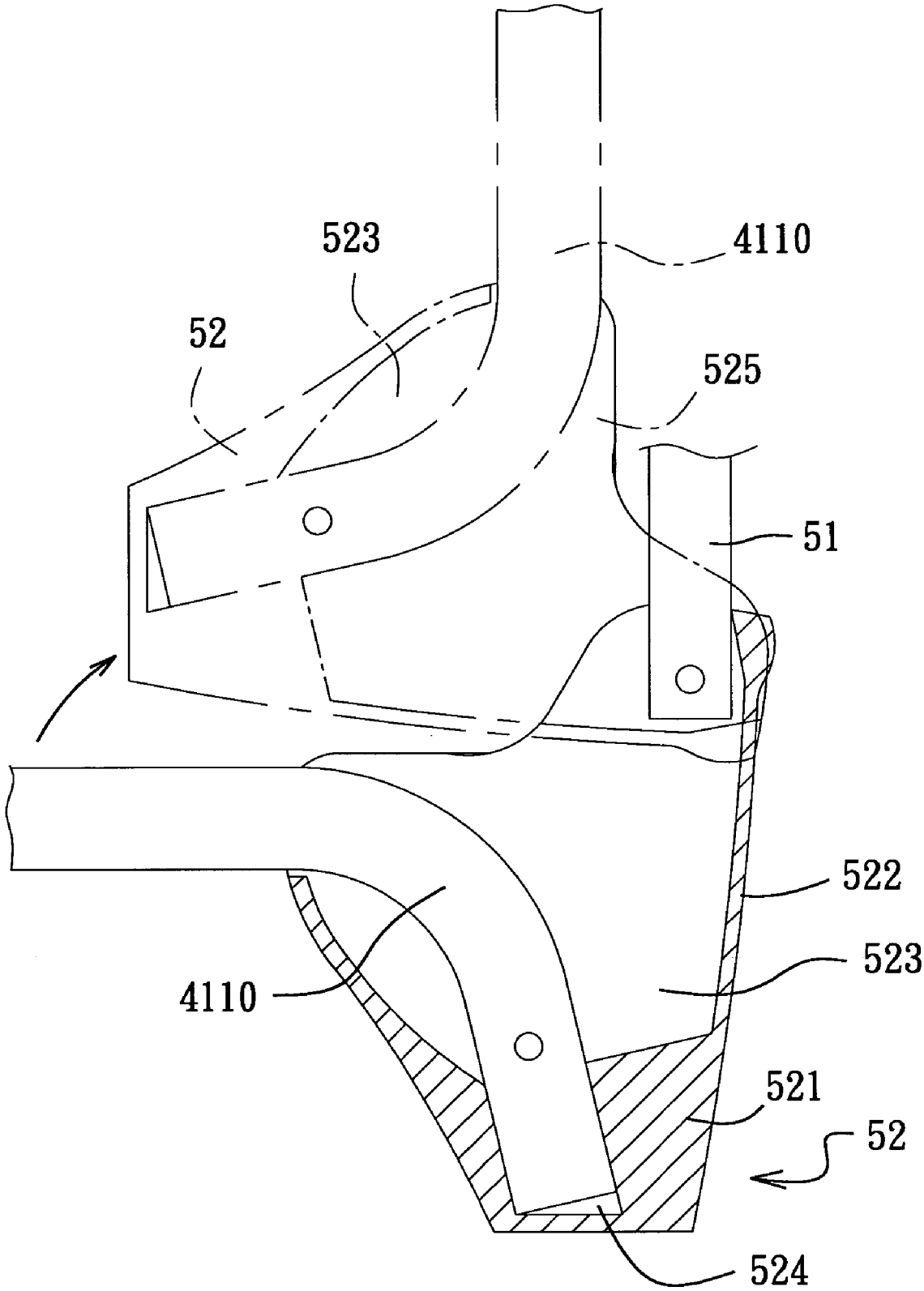
FIG. 4 is a fragmentary schematic sectional view for illustrating connection among a support rod, a bottom rod, and a foot member according to the first preferred embodiment.

Referring to FIGS. 3 and 4, the first preferred embodiment of a foldable baby crib according to the present invention is shown to include a top frame unit 3, a bottom frame unit 4, four support rods 51, and four foot members 52. The foldable baby crib can be converted from an expanded state shown in FIG. 3 to a folded state shown in FIG. 6.

The top frame unit 3 includes four top frame rods 31 and four three-way couplers 32. Each of the top frame rods 31 includes two rod segments 311 connected foldably to each other through a coupling component 33. Each of the couplers 32 connects an adjacent pair of the top frame rods 31 to a top end segment of a respective one of the support rods 51. The top frame unit 3 has a rectangular configuration when the foldable baby crib is at the expanded state.

In this embodiment, the bottom frame unit 4 includes a rod hub 42 and two bottom rod sets 41. The rod hub 42 is circular in shape, and is formed with a plurality of angularly spaced apart rod-engaging grooves 421. Each of the bottom rod sets 41 includes two bottom rods 411 having inner ends connected pivotally to the rod hub 42 at respective ones of the rod-engaging grooves 421, and outer ends connected fixedly and respectively to two of the foot members 52. The bottom rods 411 radiate from the rod hub 42 when the foldable baby crib is at the expanded state.

In this embodiment, each of the foot members 52 includes a base part 521 and a surrounding wall 522 that extends from a periphery of the base part 521 and that cooperates with the base part 521 to confine a receiving space 523. The surrounding wall 522 has an access opening 525 in spatial communication with the receiving space 523. The access opening 525 of each foot member 52 opens upwardly when the foldable baby crib is at the expanded state.

Each of the support rods 51 has a bottom end segment that is remote from the top frame unit 3 and that extends into the receiving space 523 via the access opening 525 in a respective one of the foot members 52. The bottom end segment of each support rod 51 is mounted pivotally to the surrounding wall 522 of the respective one of the foot members 52.

In this embodiment, the base part 521 of each of the foot members 52 is formed with a rod-retaining hole 524 in spatial communication with the receiving space 523. Each of the bottom rods 411 has a bent end 4110 that extends into the receiving space 523 via the access opening 525 in a respective one of the foot members 52, and further into the rod-retaining hole 524. The bent end 4110 of each bottom rod 411 is fixed to the respective foot member 52.

Figure 5:
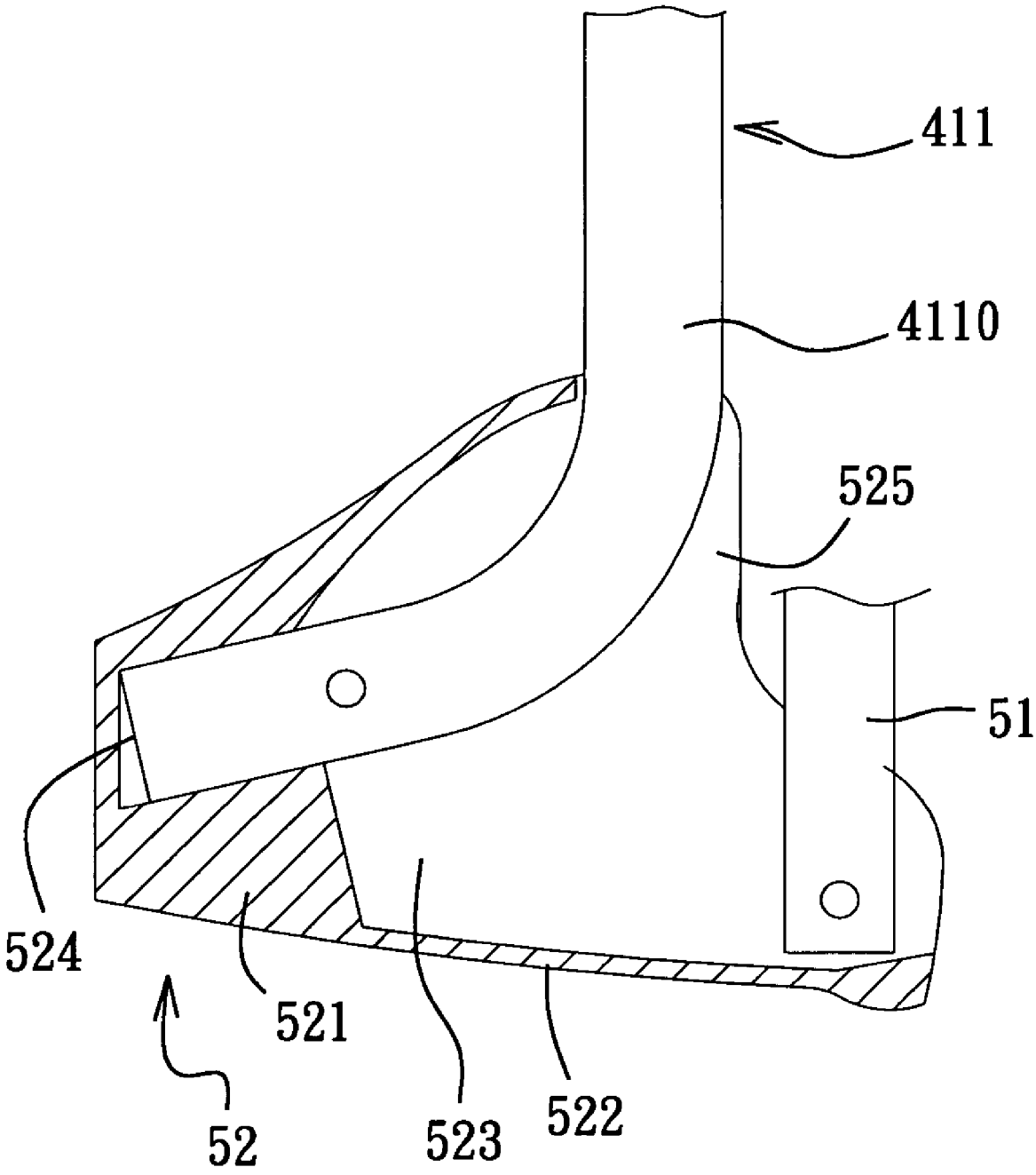
FIG. 5 is a view similar to FIG. 4, but illustrating the positions of the bottom rod and the foot member relative to the support rod when the first preferred embodiment is in a folded state.
Figure 6:
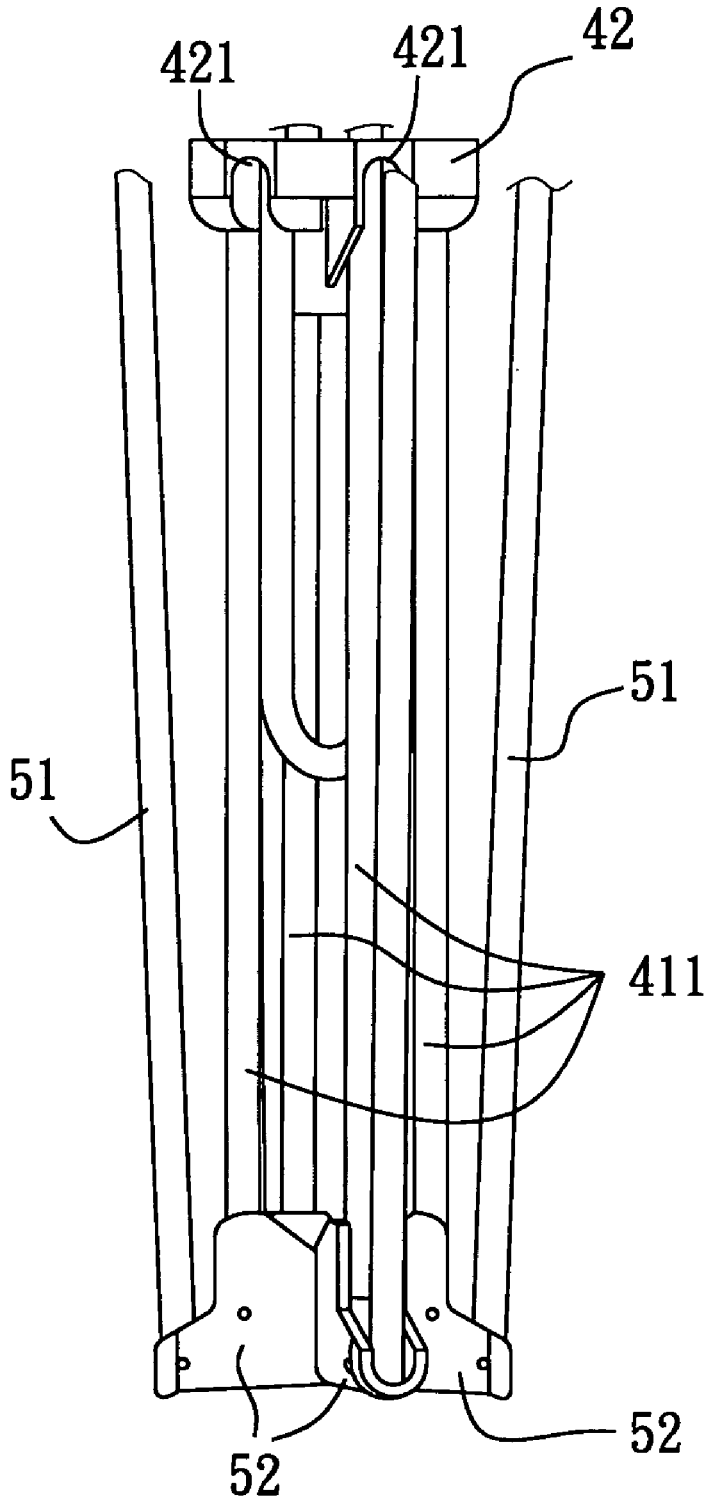
FIG. 6 is a schematic view to illustrate a folded state of the first preferred embodiment.

When converting the foldable baby crib from the expanded state of FIG. 3 to the folded state of FIG. 6, the coupling components 33 of the top frame rods 31 are unlocked so as to permit folding of the rod segments 311 of the top frame rods 31 toward each other, and the rod hub 42 is lifted upwardly so as to bring the bottom rods 411 and the support rods 51 close together. Since the bottom rods 411 are connected fixedly to the foot members 52, when the bottom rods 411 pivot relative to the rod hub 42, the bottom rods 411 will cause the foot members 52 to pivot relative to the support rods 51, as shown in FIG. 5, such that a combined length of each support rod 51 and the corresponding foot member 52 is reduced by a distance substantially equal to the height of the foot member 52 when the foldable baby crib is in the folded state.

Figure 7:
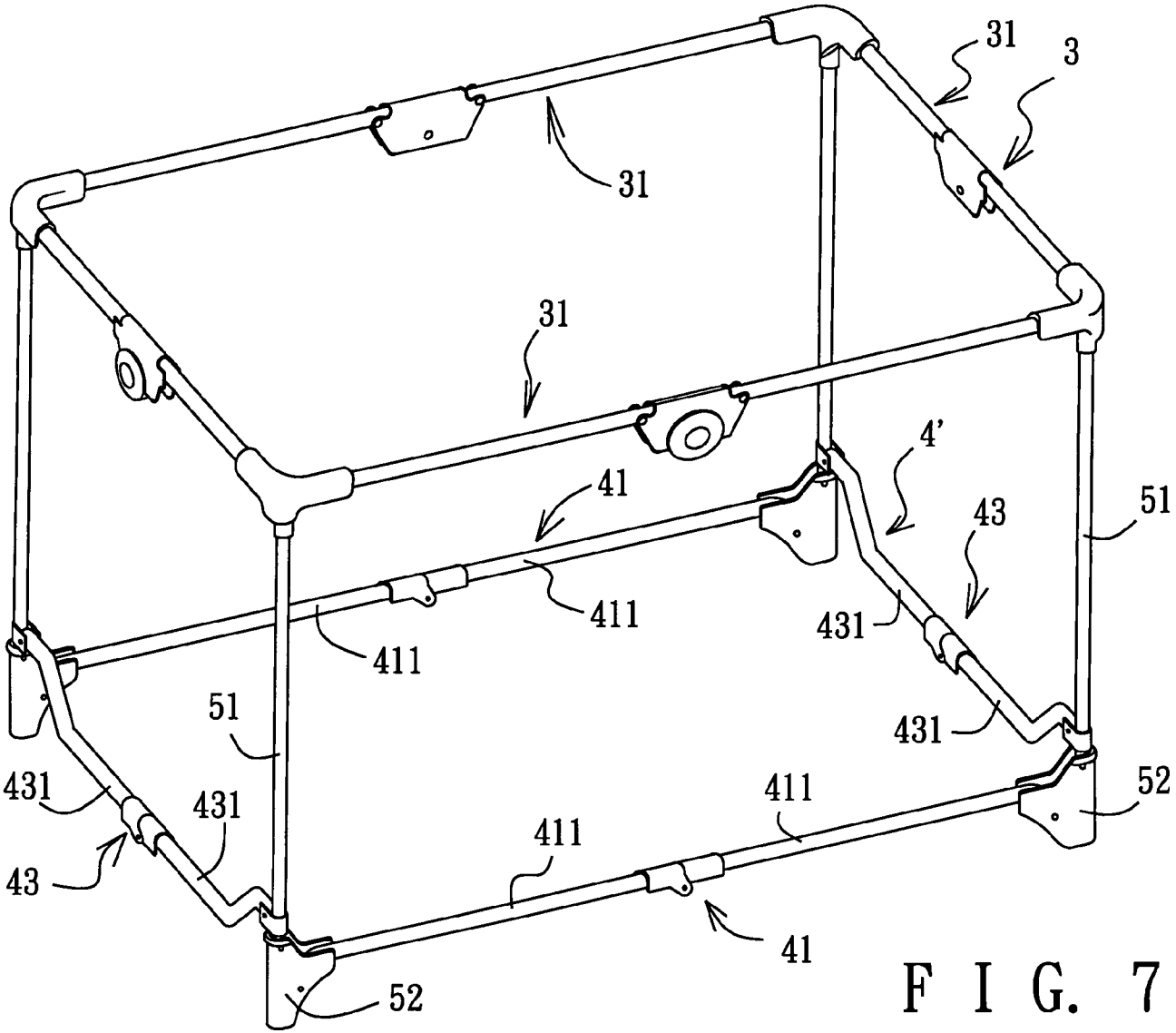
FIG. 7 is an assembled perspective view of the second preferred embodiment of a foldable baby crib according to the present invention.
Figure 9:
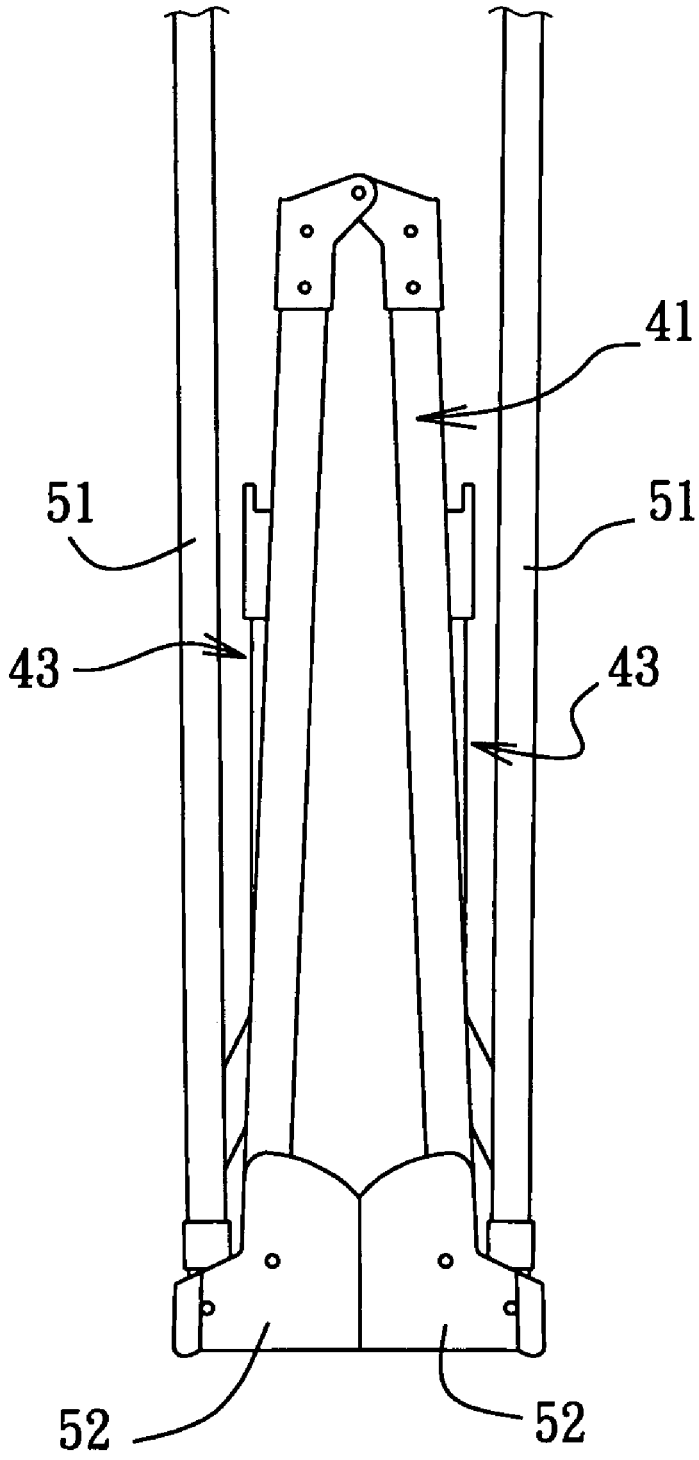
FIG. 9 is a schematic view to illustrate a folded state of the second preferred embodiment.

FIG. 7 illustrates the second preferred embodiment of a foldable baby crib according to the present invention. In this embodiment, while the top frame unit 3 is identical to that of the first preferred embodiment, the bottom frame unit 4' includes two parallel first bottom rod sets 41, and two parallel second bottom rod sets 43 transverse to the first bottom rod sets 41. Each of the first bottom rod sets 41 includes two first bottom rods 411 having inner ends connected foldably to each other, and outer ends connected fixedly and respectively to two of the foot members 52. Each of the second bottom rod sets 43 includes two second bottom rods 431 having inner ends connected foldably to each other, and outer ends connected foldably and respectively to the bottom end segments of two of the support rods 51. Unlike the bottom frame unit 4 of the first preferred embodiment, the bottom frame unit 4' has a rectangular configuration when the foldable baby crib is at the expanded state. Because the bottom rods 411 are connected fixedly to the foot members 52, when the bottom rods 411 of the first bottom rod sets 41 are pivoted when folding the baby crib, the bottom rods 411 will likewise cause the foot members 52 to pivot relative to the support rods 51 such that a combined length of each support rod 51 and the corresponding foot member 52 is reduced when the foldable baby crib is in the folded state, as best shown in FIG. 9.

Figure 8:
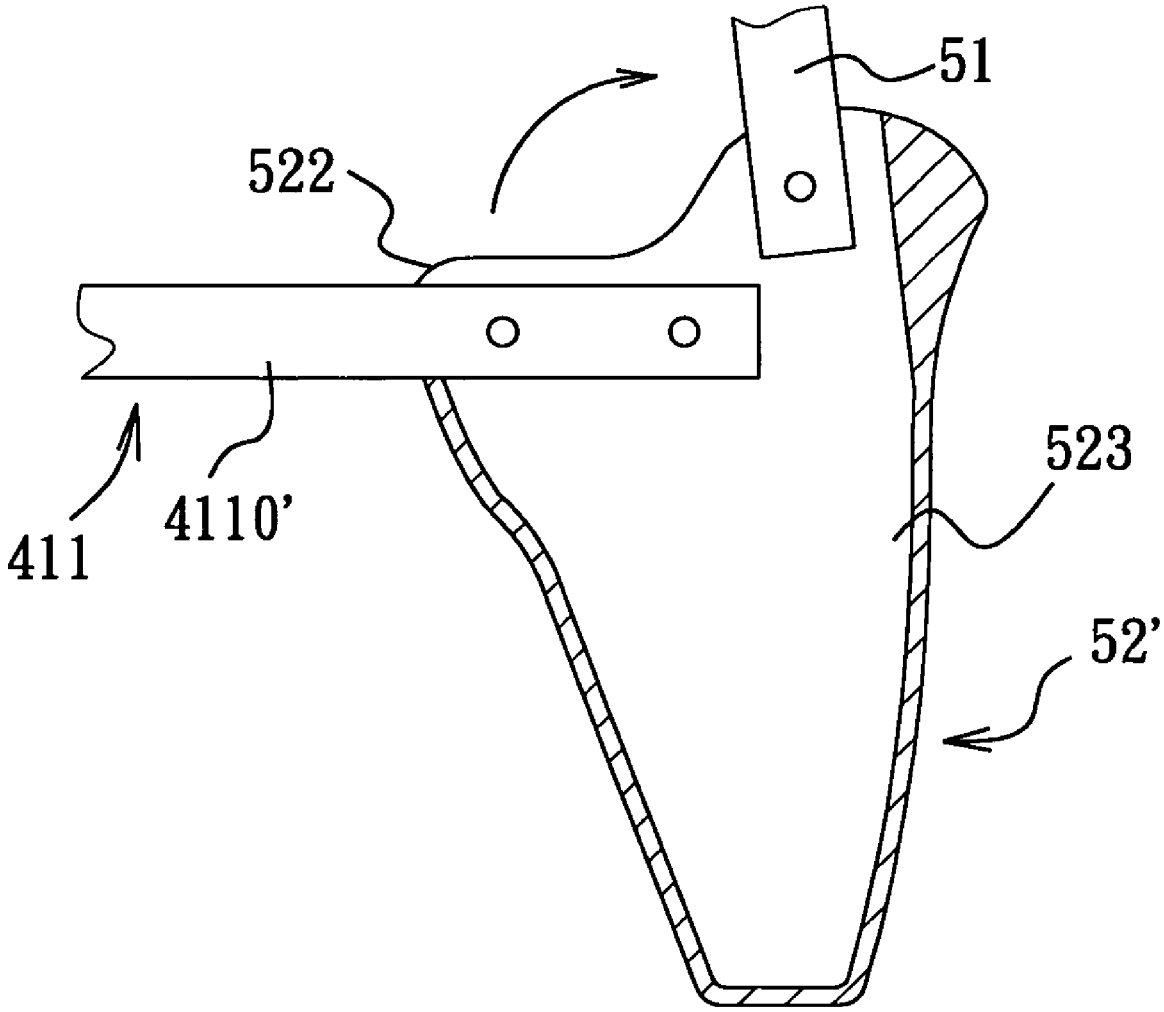
FIG. 8 is a fragmentary schematic sectional view for illustrating connection among a support rod, a bottom rod, and a modified foot member according to the second preferred embodiment.

The connection between each foot member 52 and the corresponding bottom rod 411 is not limited to that of the first preferred embodiment, and can be modified as shown in FIG. 8. Referring to FIG. 8, the end 4110' of the bottom rod 411 is straight, is extended into the receiving space 523 of the foot member 52', and is riveted to the surrounding wall 522 using a pair of rivets. Since the rod-retaining hole 524 in the previous embodiment has been omitted, the thickness of the base part 521 can be reduced to reduce the height of the foot member 52'.

Figure 10:
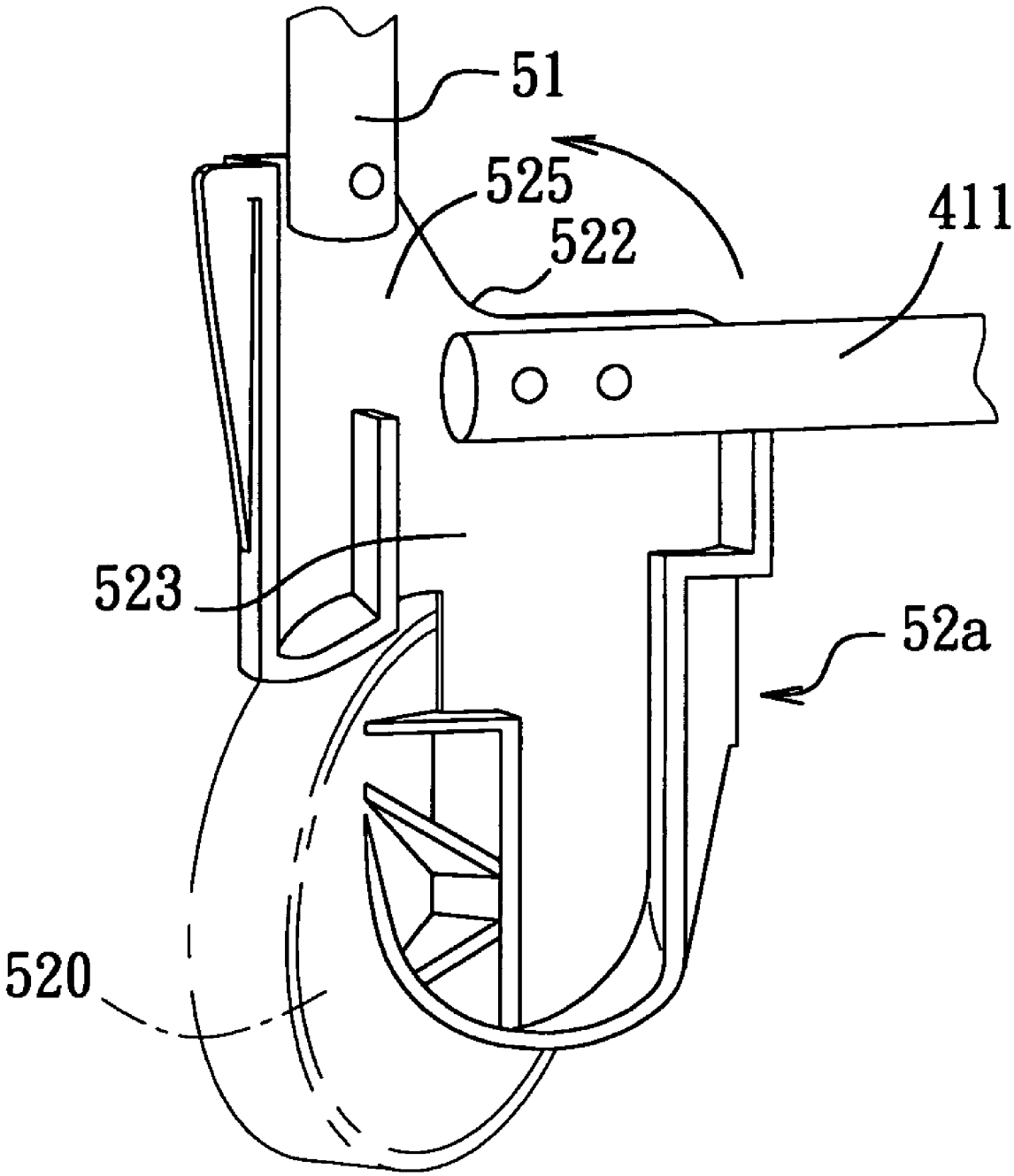
FIG. 10 is a fragmentary assembled perspective view to illustrate a support rod, a bottom rod, and a foot member of the third preferred embodiment of a foldable baby crib according to the present invention.

FIG. 10 illustrates a support rod 51, a bottom rod 411, and a foot member (52*a*) of the third preferred embodiment of a foldable baby crib according to the present invention. In this embodiment, at least one of the foot members (52*a*) of the foldable baby crib is provided with a wheel 520. Each foot member (52*a*) includes a surrounding wall 522 that confines a receiving space 523, and has a top side formed with an access opening 525 for access into the receiving space 523. The wheel 520 is mounted on an outer lateral side of the foot member (52*a*). One end of the bottom rod 411 extends into the receiving space 523 and is fixed to the foot member (52*a*) using a pair of rivets. The support rod 51 is mounted pivotally on the surrounding wall 522.

Figure 11:
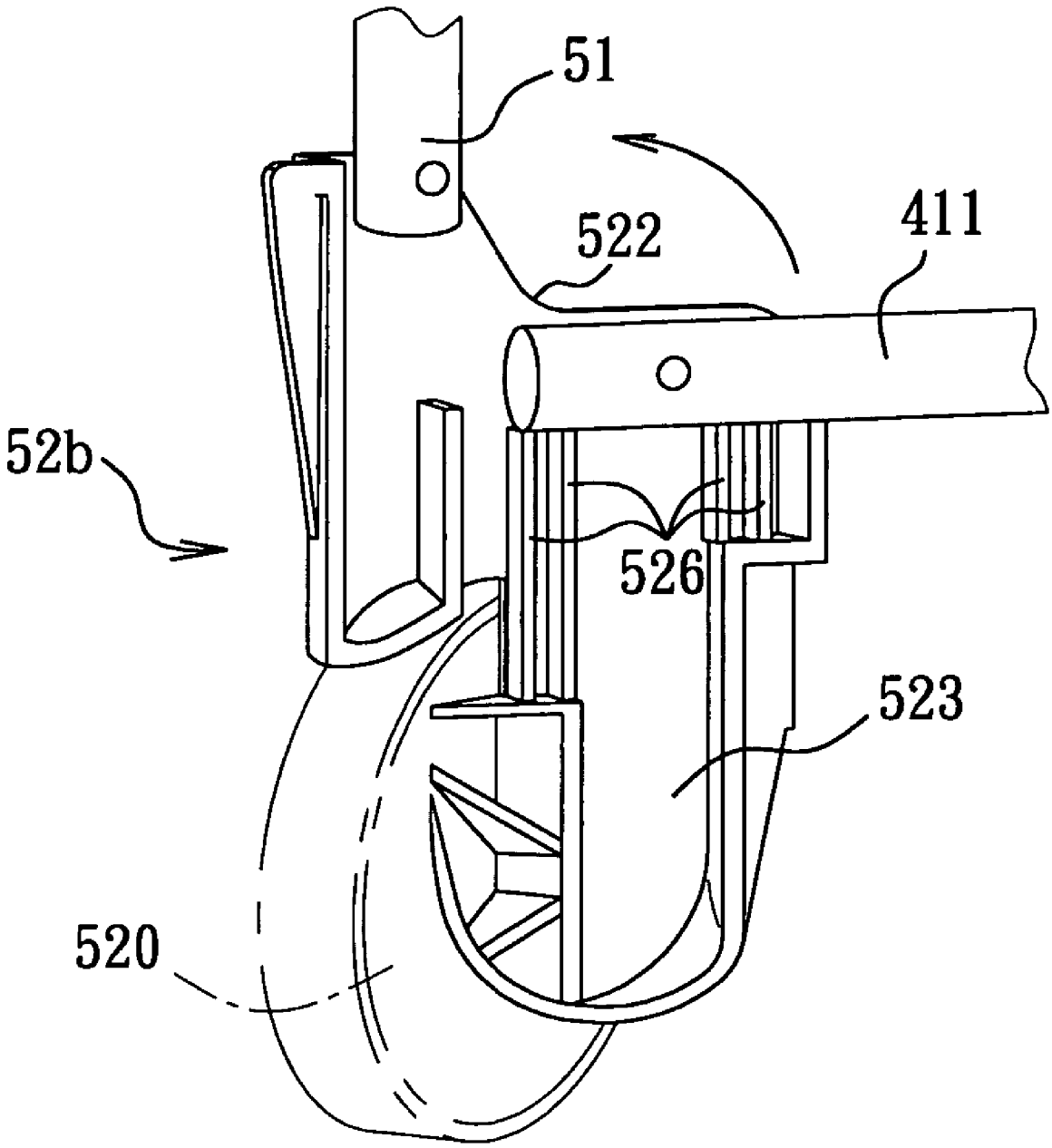
FIG. 11 is a fragmentary assembled perspective view to illustrate a support rod, a bottom rod, and a foot member of the fourth preferred embodiment of a foldable baby crib according to the present invention.

FIG. 11 illustrates a support rod 51, a bottom rod 411, and a foot member (52*b*) of the fourth preferred embodiment of a foldable baby crib according to the present invention. In this embodiment, one end of the bottom rod 411 extends into the receiving space 523 and is fixed to the foot member (52*b*) using only one rivet. The surrounding wall 522 of the foot member (52*b*) is formed with at least one support rib 526 that projects into the receiving space 523 and that abuts against a lower side of the riveted end of the bottom rod 411 so as to arrest pivoting movement between the bottom rod 411 and the foot member (52*b*). The assembly of the bottom rod 411 and the foot member (52*b*) is likewise foldable relative to the support rod 51.

In sum, by connecting fixedly the foot members 52 to the bottom rods 411 of the bottom frame unit 4, and by connecting pivotally the foot members 52 to the support rods 51, a combined length of each support rod 51 and the corresponding foot member 52 is reduced when the foldable baby crib is in the folded state, which results in a smaller storage space requirement and in lower packaging costs.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A foldable baby crib comprising:

a top frame unit;

a foldable bottom frame unit including a plurality of bottom rods, and being convertible between an expanded state and a folded state:

a plurality of support rods, each of which has a top end segment connected to said top frame unit, and a bottom end segment opposite to said top end segment; and a plurality of foot members, each of which is connected fixedly to said bottom frame unit and is connected pivotally to said bottom end segment of a respective one of said support rods;

wherein when said bottom frame unit is converted from the expanded state to the folded state, each of said bottom rods brings a respective one of said foot members to pivot relative to the respective one of said support rods.

2. The foldable baby crib as claimed in claim 1, wherein each of said foot members includes a base part and a surrounding wall that extends from a periphery of said base part and that cooperates with said base part to confine a receiving space, said surrounding wall having an access opening in spatial communication with said receiving space, said bottom end segment of each of said support rods extending into said receiving space via said access opening in the respective one of said foot members.

3. The foldable baby crib as claimed in claim 2, wherein said bottom end segment of each of said support rods is mounted pivotally to said surrounding wall of the respective one of said foot members.

4. The foldable baby crib as claimed in claim 2, wherein each of said bottom rods has one end that extends into said receiving space in the respective one of said foot members and that is fixed to said surrounding wall of the respective one of said foot members.

5. The foldable baby crib as claimed in claim 2, wherein:

said base part of each of said foot members is formed with a rod-retaining hole in spatial communication with said receiving space;

each of said bottom rods has a bent end that extends into said receiving space and into said rod-retaining hole in the respective one of said foot members and that is fixed to the respective one of said foot members.

6. The foldable baby crib as claimed in claim 4, wherein said surrounding wall of each of said foot members is formed with at least one support rib that projects into said receiving space and that abuts against a lower side of said one end of the respective one of said bottom rods.

7. The foldable baby crib as claimed in claim 1, wherein each of said foot members includes a surrounding wail that confines a receiving space and has a top side formed with an access opening for access into said receiving space.

8. The foldable baby crib as claimed in claim 7, wherein at least one of said foot members is provided with a wheel.

9. The foldable baby crib as claimed in claim 1, wherein said bottom frame unit includes a plurality of bottom rod sets, each of said bottom rod sets including two of said bottom rods which have inner ends connected foldably to each other and outer ends connected fixedly and respectively to two of said foot members.

10. The foldable baby crib as claimed in claim 1, wherein said bottom frame unit includes a rod hub and a plurality of bottom rod sets, each of said bottom rod sets including two of said bottom rods which have inner ends connected pivotally to said rod hub and outer ends connected fixedly and respectively to two of said foot members.

11. The foldable baby crib as claimed in claim 1, wherein said plurality of bottom rods include four first bottom rods and four second bottom rods, said bottom frame unit including two parallel first bottom rod sets, and two parallel second bottom rod sets transverse to said first bottom rod sets, each of said first bottom rod sets including two of said first bottom rods that have inner ends connected foldably to each other and outer ends connected fixedly and respectively to two of said foot members, each of said second bottom rod sets including two of said second bottom rods that have inner ends connected foldably to each other and outer ends connected foldably and respectively to said bottom end segments of two of said support rods.

12. The foldable baby crib as claimed in claim 1, wherein said top frame unit includes a plurality of top frame rods, and a plurality of three-way couplers, each of which connects an adjacent pair of said top frame rods to a respective one of said support rods.

13. The foldable baby crib as claimed in claim 12, wherein each of said top frame rods includes two rod segments connected foldably to each other.

14. The foldable baby crib as claimed in claim 9, wherein said top frame unit includes a plurality of top frame rods, and a plurality of three-way couplers, each of which connects an adjacent pair of said top frame rods to a respective one of said support rods.

15. The foldable baby crib as claimed in claim 10, wherein said top frame unit includes a plurality of top frame rods, and a plurality of three-way couplers, each of which connects an adjacent pair of said top frame rods to a respective one of said support rods.

16. The foldable baby crib as claimed in claim 11, wherein said top frame unit includes a plurality of top frame rods, and a plurality of three-way couplers, each of which connects an adjacent pair of said top frame rods to a respective one of said support rods.

17. The foldable baby crib as claimed in claim 1, wherein at least one of said foot members is provided with a wheel.

18. A foldable baby crib comprising:

a top frame unit;

a foldable bottom frame unit convertible between an expanded state and a folded state;

a plurality of support rods, each of which has a top end segment connected to said top frame unit, and a bottom end segment opposite to said top end segment; and a plurality of foot members, each of which is connected fixedly to said bottom frame unit and is connected pivotally to said bottom end segment of a respective one of said support rods;

wherein each of said foot members and the respective one of said support rods have a first combined length when said bottom frame unit is disposed at the expanded state, and have a second combined length when said bottom frame unit is disposed at the folded state, said second combined length being shorter than said first combined length by a distance substantially equal to a height of said foot member.

19. A foldable baby crib comprising:

a top frame unit;

a foldable bottom frame unit convertible between an expanded state and a folded state;

a plurality of support rods, each of which has a top end segment connected to said top frame unit, and a bottom end segment opposite to said top end segment; and a plurality of foot members, each of which is connected fixedly to said bottom frame unit and is connected pivotally to said bottom end segment of a respective one of said support rods;

wherein when said bottom frame unit is converted from the expanded state to the folded state, said bottom frame unit brings said foot members to pivot respectively relative to said support rods, and causes said support rods to move to said folded bottom frame unit in a single-folding action.

* * * * *